US008852350B2

(12) United States Patent
Sampson et al.

(10) Patent No.: US 8,852,350 B2
(45) Date of Patent: Oct. 7, 2014

(54) SMOKING ARTICLE AND APPARATUS AND PROCESS FOR MANUFACTURING A SMOKING ARTICLE

(75) Inventors: John Roger Sampson, Southampton (GB); Richard Oliver, Southampton (GB); Gordon Rowatt Grierson, Southampton (GB); Dominic Woodcock, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 2350 days.

(21) Appl. No.: 10/590,689

(22) PCT Filed: Feb. 28, 2005

(86) PCT No.: PCT/GB2005/000669

§ 371 (c)(1),
(2), (4) Date: Aug. 25, 2006

(87) PCT Pub. No.: WO2005/082180

PCT Pub. Date: Sep. 9, 2005

(65) Prior Publication Data

US 2007/0204869 A1 Sep. 6, 2007

(30) Foreign Application Priority Data

Feb. 27, 2004 (GB) ..... 0404324.6

(51) Int. Cl.
*A24B 15/00* (2006.01)

(52) U.S. Cl.
USPC ..... 131/274; 131/360; 131/365; 131/331; 131/335

(58) Field of Classification Search
None
See application file for complete search history.

(56) References Cited

U.S. PATENT DOCUMENTS

| | | | | |
|---|---|---|---|---|
| 3,236,244 | A | 2/1966 | Irby et al. | |
| 3,744,496 | A | 7/1973 | McCarty et al. | |
| 5,105,836 | A | 4/1992 | Gentry et al. | |
| 5,131,416 | A * | 7/1992 | Gentry | 131/365 |
| 5,137,034 | A | 8/1992 | Perfetti et al. | |
| 6,705,325 | B1 | 3/2004 | Hicks et al. | |
| 2002/0185143 | A1 | 12/2002 | Crooks et al. | |
| 2003/0159703 | A1 | 8/2003 | Yang et al. | |

FOREIGN PATENT DOCUMENTS

| | | | |
|---|---|---|---|
| EP | 0533423 | A1 | 9/1992 |
| EP | 1421863 | A1 | 7/2002 |
| WO | 9320722 | | 10/1993 |
| WO | 03013284 | A1 | 2/2003 |

* cited by examiner

*Primary Examiner* — Richard Crispino
*Assistant Examiner* — Phu Nguyen
(74) *Attorney, Agent, or Firm* — Middleton Reutlinger; John F. Salazar; Charles I. Sherman

(57) ABSTRACT

A smoking article, and a method and apparatus for producing a smoking article, in which a web material containing an adsorbent material such as activated carbon and a stabilized flavorant such as menthol is positioned adjacent an interior surface of a cigarette wrapper to deliver flavor to a smoker with minimal/insignificant migration of flavor to other parts of the smoking article or packaging. The web material may be a section that extends over only a portion of the smoking article to deliver flavor to a smoker at a specific point during smoking and if positioned at the mouth end of a smoking article will be able to deliver a flavor sensation in the final puff(s).

44 Claims, 8 Drawing Sheets

SMOKING ARTICLE AND APPARATUS AND PROCESS FOR MANUFACTURING A SMOKING ARTICLE

CROSS REFERENCE TO PRIOR APPLICATION

This application is a national stage filing (35 U.S.C. 371) of PCT/GB2005/000669, filed on Feb. 28, 2005, which claims priority to and benefit from Great Britain Patent Application No. 0404324.6, filed on Feb. 27, 2004, currently pending.

This invention relates to smoking articles, and in particular to smoking articles having flavourant material therein.

Flavourant materials such as menthol have been applied to smoking articles to modify the smoke and taste characteristics thereof. Flavourant materials have been added to smoking articles by various methods, for example by spraying a flavourant-containing solution onto tobacco or by applying flavourant material to the cigarette wrapper. However, due to the volatile or semi-volatile nature of many flavourant materials a significant amount of the flavourant material is lost via evaporation during the manufacture and storage of the smoking articles. Further, during smoking, more flavourant material is volatilised by the smoke in the initial puffs, resulting in uneven provision of the flavourant material to the consumer.

In order to prevent loss or premature volatilisation of the flavourant material various substances have been utilised to encapsulate the flavourant material. A number of flavourant encapsulation techniques involve encapsulation of a flavourant material within a polysaccharide coating. For example, EP 0 490 559 discloses a filament comprising a core of flavourant material and polysaccharide binder with a coextensive alginate sheath coating. It is however difficult to insert such a filament into a cigarette using conventional high speed machinery. The control of flavour delivery to the consumer at specific stages during smoking is also not easily achieved using such filaments due to a necessity for precise positioning of the flavourant material in a cigarette.

A further encapsulation technique for smoking articles involves microencapsulation of a flavourant material, and incorporation of the microcapsules into a tobacco blend. Disadvantages of such a technique include the difficulty in attaining an even distribution of microcapsules in the smoking article if desired, or alternatively the difficulty in precisely positioning the microcapsules in a specific location in a smoking article.

Adsorbent material having a microporous structure also possesses stabilising qualities and is able to retain flavourant material and allow the flavourant material to be released upon heating to a given temperature, such as for example during smoking.

U.S. Pat. No. 3,150,668 describes a cigarette having flavourant therein to convey to the consumer the point at which smoking should be ceased. A retarding agent is employed with the flavourant to prevent flavourant reaching the consumer during the initial puffs of the cigarette. The retarding agent is in liquid or solid form and may be activated carbon. The flavourant and retarding agent are mixed together before being constructed into a cigarette. However, the mixture is not easily positioned at a location within a cigarette, particularly at the high speeds used in cigarette manufacture.

It is considered to be advantageous to be able to simply and effectively position a stabilised flavourant material in a smoking article and particularly towards one end of a smoking article only so that upon smoking the consumer will encounter a flavour sensation, typified by the flavourant(s) used, for example during the final puff or final few puffs. Ideally menthol, when used as the flavourant material, will provide a refreshing sensation and/or taste and will provide a "fresh finish" to the consumer.

It is an object of the present invention to provide a smoking article having stabilised flavourant for delivery to the consumer during smoking.

It is a further object of the present invention to provide a smoking article having a precisely positioned stabilised flavourant therein.

It is a further object of the present invention to provide a process and apparatus for producing a smoking article having a stabilised flavourant located therein.

It is an even further object of the present invention to provide a flavour sensation in the final puff(s) of the smoking article.

A further aspect of the invention is to reduce particulate matter in the smoke without loss of flavour characteristics.

The present invention provides a smoking article comprising a rod of smokable material, a wrapper about said rod of smokable material and a web material comprising an adsorbent material and a flavourant material, the web material being positioned between said rod of smokable material and said wrapper.

The wrapper of the smoking article is suitably a conventional cigarette paper well known in the art.

The smoking article may be wrapped in more than one wrapper, and may be, for example, double wrapped. It is preferred however that the smoking article is wrapped in a single wrapper.

It is by preference that the smoking article comprises a filter element. The filter element may be a multiple filter comprising multiple sections such as, for example, a dual or triple filter. Suitable filters are well known to those skilled in the art. A preferred filter element contains an adsorbent material for the reduction of vapour phase constituents of smoke. Such filters known in the art include Dahnatian filters in which particulate activated carbon is interspersed in the cellulose acetate material of the filter and cavity filters in which a cavity portion of a multi-segment filter is filled with activated carbon granules. When the patch is positioned near to the mouth end of the smoking article it has been found that the flavourant is released from the web material without being adsorbed by the adsorbent material of the filter and without affecting the ability of the adsorbent in the filter to reduce vapour phase constituents of the smoke.

Preferably the web material is a fibrous sheet material. More preferably the fibrous sheet material is a cellulosic sheet material or a tobacco-containing sheet material. The fibrous sheet material is advantageously a cellulosic web material. More advantageously the cellulosic web material is a paper web material. The paper web material may be flat, creped or calendared. Advantageously the adsorbent material is incorporated within the web material, the adsorbent being an integral component of the web material.

It is by preference that the adsorbent material comprises the flavourant material. Suitably the adsorbent material is one or more of the following: zeolite, sepiolite, clay, activated alumina, mineral, resin, carbon. Preferably the adsorbent material is carbon. More preferably the adsorbent material is activated carbon.

Advantageously the adsorbent material is in granular, powder or particulate form. Where the adsorbent material is in granular, powder or particulate form, the adsorbent material preferably has particle sizes of less than 500 μm and preferably less than 100 μm. More preferably the adsorbent material has particle sizes of less than 50 μm and most preferably has a mean particle size of less than 20 μm. The particle size is considered to be the diameter of the particle.

Suitably the level of loading of the adsorbent material in the web material is less than 70% by weight of the web material. Preferably the level of loading of the adsorbent material in the web material is less than 50% by weight of the web material. Advantageously the adsorbent material loading in the web material is 10-45% by weight of the web material.

When the adsorbent material is activated carbon it is preferred that the carbon has a level of activity up to 180% CTC. More preferably the carbon has an activity of 40-160% CTC. Activity of carbon is measured in percent carbon tetrachloride (CTC), a measurement well known in the art. Carbon is weighed, exposed to CTC and the weight of the carbon subsequently remeasured. The increase in weight of the carbon is calculated as a percentage.

Suitably the flavourant material is a volatile or semi-volatile flavourant. Flavourant materials suitable for use in the smoking article of the present invention include: menthol (natural and/or synthetic), alcohols, esters, ketones, lactones, essential oils, and aldehydes. A preferred commonly used flavourant material is menthol.

Further materials may be added to the web material of the invention. Such materials include inorganic fillers and burn additives. For example, a preferred filler material is calcium carbonate. Other inorganic fillers known in the art include titanium oxide, magnesium oxide, calcium sulphate, clays and kaolins. Similarly, preferred burn additives include sodium citrate and potassium citrate. Other burn additives known in the art include other water soluble citrates, acetate and phosphate compounds.

Preferably the smokable material is a tobacco material. Suitably the tobacco material comprises one or more of stem, lamina and tobacco dust. It is preferred that the tobacco material comprises one or more of the following types: Virginia or flue-cured tobacco, Burley tobacco, Oriental tobacco, reconstituted tobacco and stem. It is much by preference that the smokable material comprises a blend of tobacco material. Advantageously the smokable material comprises 10-80% Virginia tobacco, 0-60% Burley tobacco, 0-20% Oriental tobacco, 0-30% reconstituted tobacco, 0-50% expanded tobacco and 0-30% stem.

Advantageously the web material is adhered to a surface of the wrapper, which surface is a surface facing the rod of smokable material. The web material is suitably adhered to the wrapper by an adhesive. Preferably the adhesive is one of the following: a heat-activatable adhesive, PVA, starch, starch solution. The preferred adhesive is PVA.

It is preferred that the web material extends over only a portion of the smoking article, and in particular over only a portion of the rod of smokable material. A portion of the smoking article may be in terms of length of smoking article and/or circumferential distance of the smoking article. It is preferred that the web material extends over only a portion of the length of the smoking article, and in particular over only a portion of the length of the rod of smokable material. Extension over only a portion of the smoking article provides a specific placement of the flavourant, which is resultantly released to the consumer at a given point during smoking corresponding to the position of the web material. This is achievable as a result of the significant 'locking power' of the adsorbent within the web material to prevent escape or migration of the flavourant from the web material into other parts of the smoking article. Locking power of the adsorbent in the web material is determined using a sensitive Solid Phase Micro-Extraction (SPME) technique which is designed to quantify the flavourant stabilisation efficiency during storage. The web material may extend over a portion of the smoking article at or towards the mouth end or the lighting end of the smoking article. It is by preference that the web material extends over only a portion of the smoking article at or towards the mouth end of the smoking article.

The web material extends wholly or partly along the length of the rod of smokable material. If it is desired to deliver flavourant at a specific point during the smoking of the smoking article the web material preferably extends only partly the length of the rod of smokable material. Preferably the web material extends 10-80%, and preferably 30-80%, of the length of the rod of smokable material. In a first aspect the web material extends from a point at the mouth end of the smoking article to a point towards the end away from the mouth end. Advantageously the point towards the end away from the mouth end is a point 10-80%, and preferably 30-80%, of the distance along the rod of smokable material from the mouth end of the smoking article. In a second aspect the web material extends from a first point towards the mouth end of the smoking article to a second point towards the end of the smoking article away from the mouth end thereof. Preferably the first point towards the mouth end of the smoking article is a point at least 10% of the distance along the rod of smokable material from the mouth end of the smoking article. Further it is preferred that the second point towards the end of the smoking article away from the mouth end thereof is a point 11-80%, and preferably 30-80%, of the distance along the rod of smokable material from the mouth end of the smoking article. Two or more regions of web material may extend along the length of the rod of smokable material.

The invention provides for more than one flavourant in a smoking article. For example, two flavourants, being of similar or different flavours, may be included in a single smoking article. This can be achieved by placing two separate web materials in a smoking article, each web material containing an adsorbent and a flavourant. Alternatively, a single web material may comprise two different flavourants, including multiple lines of separate individual flavours or mixtures of flavourants. A yet further alternative is that a smoking article comprises a web material of the invention and also comprises a tobacco blend having flavourant incorporated therein. A preferred embodiment is that a smoking article comprises a web material of the invention having a flavourant therein and a tobacco blend having the same flavourant therein, such that the web material effectively provides the smoker with an extra amount of the flavourant, for example in the final few puffs. This is particularly advantageous in a mentholated smoking article in which menthol flavourant in the tobacco blend provides a menthol impact to the smoker during smoking, and a web material comprising menthol flavourant provides a strong menthol impact in the final puffs.

The present invention further provides a method of flavouring an adsorbent-containing web material comprising applying a flavourant to a surface of the web material and subjecting the material to a temperature greater than 20° C. for a period of at least 30 minutes to allow adsorption of the flavourant by the adsorbent in the web material.

Preferably the flavourant is applied to the web material by a flavourant applicator means. Preferably flavourant is applied to the surface of the web material as a stream of flavourant. More preferably flavourant is applied to the web material as a plurality of streams of flavourant. Suitably the plurality of streams of flavourant is applied to the web material in a line or in an array. When applied in an array the array comprises two lines of streams of flavourant, one of the lines being offset from the streams of flavourant in an adjacent line. Suitably flavourant is applied to a surface of the web material as 1-30 streams of flavourant. Advantageously flavourant is applied to a surface of the web material as 4-18 streams of flavourant. Suitably each stream of flavourant has a cross-section substantially corresponding to the shape of an orifice in the applicator means through which the flavourant is passed. Preferably each stream of flavourant is in the form of a filament and has a substantially circular cross-section.

If the flavourant is solid at room temperature the flavourant is heated to maintain the flavourant in a molten liquid state. Advantageously the flavourant is heated to a temperature of 40-55° C. It is preferable that the flavourant is heated by the applicator means, in particular by a supply means of the applicator means, the supply mea ns being operable to supply flavourant from a flavourant source to an applicator head operable to apply flavourant to the web material.

Suitably the web material is fed from a first web material holding means to a second web material holding means. Preferably the first and/or second web material holding means comprises a mandrel. Preferably the web material is fed from an unwind mandrel to a driven rewind mandrel.

Preferably the web material is fed to a guide roller along the transport path, the web material being guided by the guide roller along the transport path. More preferably the web material is fed to a plurality of guide rollers along the transport path.

Preferably the adsorbent material is carbon, and is even more preferably activated carbon. Advantageously the adsorbent is in granular, powder or particulate form.

Preferably the flavourant is a volatile or semi-volatile flavourant. Suitably the flavourant is in liquid or molten state. Preferably the flavourant is one or more of the following compound types: heterocyclic compound, terpene hydrocarbon, alcohol, acid, ester, ketone, lactone, essential oil, aldehyde, or menthol. Advantageously the flavourant is menthol.

Preferably the web material is a fibrous sheet material. More preferably the web material is a cellulosic or tobacco-containing sheet material. Advantageously the web material is paper. The paper may be flat, creped, or calendared paper.

The web material undergoes an equilibration stage after application of flavourant thereto, which stage involves allowing the flavourant applied to the web material to be effectively adsorbed by the adsorbent within the web material. This stage is known as the "bulking" or "curing" stage. It has been surprisingly found that curing the web material for only a relatively short period of time at a temperature above ambient temperature results in a significantly improved adsorption of flavourant by the adsorbent of the web material. Suitably the web material is stored for a period of up to 96 hours to allow equilibration of the flavourant within the web material at a temperature operable to promote equilibration of the flavourant in the web material. Preferably the temperature during the curing stage is 25-80° C. and an optimum temperature range is between 40° C. and 80° C. It is advantageous that flavourant is adsorbed as quickly as possible to minimise duration of storage at a raised temperature. However, due to the nature of the web material it is not desirable to subject the web material to high temperatures that may char or discolour the web material. Temperatures above 100° C. are not preferred. An ageing stage may also be included, in which the web material is stored in ambient conditions for a specified time period, which may range from 2 days to several months. Preferably the ageing stage is between 2 days and 6 weeks.

Alternatively, in an embodiment applicable to all aspects of the invention, the adsorbent material, such as activated carbon, may be pre-flavoured and subsequently formed into a web material.

The present invention also provides an apparatus for applying flavourant to a web material, the web material comprising an adsorbent material, the apparatus comprising first web material holding means, applicator means capable of applying flavourant to the web material and second web material holding means.

Preferably the applicator means comprises an applicator head for application of the flavourant to the web material and a supply means for supplying flavourant to the applicator head.

Preferably the applicator head has an opening in a surface thereof through which flavourant may be passed. More preferably the applicator head has a plurality of openings in a surface thereof. Advantageously the applicator head has 1-30 openings in a surface thereof. More advantageously the applicator head has 4-18 openings in a surface thereof. Suitably an opening in a surface of the applicator head is circular or elongated. Preferably the openings are located in a removable plate. Suitably the openings are arranged in a line or in an array, the array comprising two lines of openings in which the openings in one of the two lines are offset from the openings in an adjacent line.

Suitably the applicator means comprises heating means to heat the flavourant and maintain the flavourant in a molten liquid state. It is by preference that the heating means heats the supply means. Most preferably the supply means is heated to a temperature of 40-55° C.

Preferably the first and/or second holding means comprises a mandrel. More preferably the first holding means is an unwind mandrel and the second holding means is a rewind mandrel. The unwind mandrel serves to feed the web material thereon therefrom and the rewind mandrel receives the web material that is fed thereto. It is preferred that the rewind mandrel is driven.

Suitably the web material comprising an adsorbent material is in the form of a bobbin. Preferably the bobbin is held by the first holding means.

Preferably the apparatus comprises a guide roller, which guide roller controls the path of the web material. More preferably the apparatus comprises a plurality of guide rollers. Advantageously the/or each guide roller is in contact with the web material.

Suitably a first guide roller is positioned such that web material fed from the first holding means is fed around the first guide roller. A second guide roller is positioned such that web material is fed around the second guide roller after being fed around the first guide roller and before the web material reaches the applicator means. Preferably a third guide roller is positioned such that the web material is fed around the third guide roller after having flavourant applied thereto and before being received by the second holding means.

It is preferred that the apparatus comprises a brake arm assembly. The brake arm assembly is in contact with a guide roller. Preferably the brake arm assembly is in contact with a plurality of guide rollers. The brake arm assembly is movable and ensures that the web material is maintained at a given tension. The brake arm assembly is contactable with the first holding means. Preferably the brake arm assembly contacts a drum of the first holding means. The degree of pressure exerted by the brake arm assembly on the drum controls the tension of the web material being fed from the first holding means. When the web material is under tension an end of the brake arm assembly away from the first holding means is raised, pivoting the end of the brake arm assembly contactable with the drum of the first holding means away therefrom. In contrast, when the web material leaving the first holding means is under insufficient tension the end of the brake arm assembly away from the first holding means and contactable with a guide roller is in a lowered position and accordingly the end of the brake arm assembly contactable with the first holding means is pressed against the drum of the first holding means, the pressure on the drum slowing the feed of the web material from the first holding means.

Suitably the apparatus comprises an encoder. The encoder is preferably positioned along the web feed path before the location of the applicator means. Preferably the encoder is in contact with the web material along the web feed path and is able to measure the speed of feed of the web material. Advantageously the encoder is in communication with the second holding means and/or a motor means that drives the second holding means. As the speed of feed of the web material is communicated to the second holding means and/or motor means that drives the second holding means the speed at which the second holding means is driven and receives web material is varied such that a constant web material speed is maintained. The encoder is also able to control the flow rate of flavourant application on the basis of the speed of the web material.

The present invention also provides a method of making a smoking article according to the present invention.

The method of making a smoking article comprises feeding a web material, the web material comprising an adsorbent material and a flavourant, to a cutting means, cutting said web material into sections, transferring said sections onto a wrapper and circumscribing a rod of smokable material with said wrapper.

Preferably the web material is cut into sections of a specified length, for example by a rotary knife assembly. It is preferred that the web material is cut to a length corresponding to twice the length of web material in the smoking article product. The section of web material after being applied to a wrapper will then be constructed into a double length smoking article, which article is subsequently cut to form two smoking articles of the desired length and having a section of web material in each of the smoking articles of the desired length. Preferably the length of the web material section in the finished smoking article corresponds to 40-80% of the length of the rod of smokable material of the smoking article. Accordingly it is preferred that the web material is cut to a length corresponding to 80-160% of the length of the rod of smokable material of the finished smoking article.

Alternatively the web material is cut into sections having a length less than the length of the smoking article. Even more advantageously the web material is cut to a length corresponding to half the length of the smoking article or less. In this alternative embodiment the section of web material is not subsequently cut in a further step during the making of a smoking article on a smoking article making machine. This alternative embodiment is preferred for smoking articles in which the web material is positioned at a distance from the mouth end of the rod of smokable material, a double-length web material section not being suitable for such a position of the web material in the smoking article.

Suitably adhesive is applied to a surface of the web material. Preferably adhesive is applied to a surface of the web material by an adhesive applicator. It is by preference that the adhesive applicator is located along the feed path before the cutting means. The surface having adhesive applied thereto is applied to a surface of a wrapper, the wrapper being, for example, a cigarette paper or a plugwrap. Advantageously the web material is applied to a surface of the wrapper at a location corresponding to the mouth end of the smoking article.

Alternatively adhesive is applied to a surface of a wrapper by an adhesive applicator. Preferably the surface of the wrapper having adhesive applied thereto is a surface to which a section of web material is applied. Advantageously the adhesive is applied to a surface of the wrapper at a location corresponding to the mouth end of the smoking article in the finished product.

The method further comprises supplying a wrapper to a wrapper feed path such that the wrapper may have sections of web material transferred thereto. Suitably the wrapper feed path is adjacent an assembly capable of transferring sections of web material to the wrapper. Preferably the wrapper feed path is in contact with the assembly capable of transferring sections of web material to the wrapper.

Suitably the assembly that transfers sections of the web material to the wrapper is a vacuum assembly. Preferably the vacuum assembly comprises a suction drum. The sections of web material are held on a surface of the suction drum by a suction force. Preferably the vacuum assembly accelerates the sections of web material during transfer of the sections of web material to the wrapper. More preferably the vacuum assembly accelerates the sections of web material to a speed equal to that of the wrapper.

Preferably the wrapper is fed to a smoking article making machine such as a cigarette making machine.

Preferably the wrapper feed path comprises guide means to allow the wrapper to be precisely aligned with the sections of web material being transferred thereto. More preferably the guide means is a paper tracking guide.

Suitably adhesive is applied over the entire surface of the web material or over only a part thereof. When applied over only a part of a surface of the web material it is preferred that the adhesive is applied in a strip towards an edge of the web material. Preferably adhesive is applied in a strip along an edge of the web material. Alternatively adhesive is applied in a strip positioned at a distance from the edge of the web material, the strip being parallel to the edge of the web material. Advantageously adhesive is applied in a strip at each longitudinal edge of the web material. Preferably the or each strip of adhesive is about 2 mm wide. When the adhesive is applied in a strip positioned at a distance from the edge of the web material it is preferred that the adhesive is positioned at a distance of about 2 mm from an edge of the web material.

Alternatively, the web material is cut to a specified length and is applied to a wrapper, the web material and wrapper having pressure applied thereto to adhere the web material to the wrapper. In this aspect no adhesive is used to adhere the web material to the wrapper. Suitably a pinch belt is used to apply pressure to the web material and wrapper. Preferably pressure is applied to the web material and wrapper from each side thereof. Preferably two pinch belts are used, a pinch belt being positioned on each side of the wrapper.

When adhesive is used to adhere the web material to the wrapper the wrapper feed path optionally comprises a heater means. Preferably the heater means permanently bonds the section of web material to the wrapper. If heat activatable adhesive is used to adhere the section of web material to the wrapper the heater means activates the heat-activatable adhesive.

In an alternative embodiment that allows a patch of web material to be offset from the mouth end of the smoking article the web material is fed along a plurality of feed paths and transferred from each feed path to a cigarette wrapper. The web material may be fed from a plurality of web material holding means along the plurality of feed paths. In this case the web material from the web material holding means is cut into sections by a plurality of cutting means, each cutting means cutting the web material from one of the plurality of web holding means. It is, however, preferred that the web material is fed from a single web material holding means along a single feed path to a slitting means that slits the web material to form a plurality of web material feed paths. Each of these web material feed paths leads to a cutting means to cut the web material into sections before being transferred to a cigarette wrapper. Suitably sections of web material are transferred from the plurality of feed paths to a single cigarette wrapper. Preferably sections of web material are transferred in alternating manner from each of the plurality of feed paths to the cigarette wrapper. It is advantageous that the web material is slit by a single slitting means to form two web material feed paths and fed to two cutting means.

The present invention provides an apparatus for producing a smoking article according to the present invention comprising a means for supplying a web material containing an adsorbent and a flavourant to a cutting means, a cutting means operable to cut the web material into sections, an assembly for transferring sections of web material onto a wrapper, an adhering means to bond the web material onto a wrapper, and smoking article forming means.

The present invention further provides an apparatus for applying web material onto a wrapper, the web material containing an adsorbent material and a flavourant, the apparatus comprising means for supplying a web material containing an adsorbent and a flavourant, cutting means for cutting the web material into lengths, an assembly for transferring the lengths of web material to the wrapper, and adhering means for bonding the web material to the wrapper.

Preferably the means for supplying the web material is a mandrel. Suitably the mandrel is capable of holding a bobbin of web material.

Preferably the cutting means comprises a housing and a knife. Suitably the knife is mounted on the housing. Preferably the housing is rotatable. Advantageously the cutting means comprises a plurality of knives. More advantageously each of the plurality of knives is spaced equidistantly on the housing.

Suitably the assembly for transferring lengths of web material onto a wrapper is positioned adjacent to the cutting means. Preferably the cutting means is in contact with the assembly for transferring lengths of web material onto a wrapper such that the web material is cut into lengths against the assembly for transferring lengths of web material onto a wrapper. Preferably the assembly for transferring lengths of web material onto a wrapper is a vacuum assembly. More preferably the assembly for transferring lengths of web material onto a wrapper comprises a suction drum. Advantageously the assembly for transferring lengths of web material onto a wrapper is operable to accelerate lengths of web material to a greater speed. Preferably the greater speed is approximately equal to a speed at which the wrapper is moving.

In a first aspect of the invention the adhering means comprises an adhesive applicator. Preferably the adhesive applicator comprises a roller and an adhesive source. The roller is in contact with the adhesive source and is operable to transfer the adhesive from the adhesive source to the web material. More preferably the adhesive applicator comprises first and second rollers. Suitably the first roller is in contact with the adhesive source and the second roller and is operable to transfer adhesive from the adhesive source to the second roller, which second roller is operable to transfer adhesive from the first roller to the web material. Advantageously the adhesive applicator is able to apply adhesive in various patterns to the web material. Suitably the first roller has a channel therein capable of containing adhesive. Adhesive is transferred from the channel of the first roller to the second roller. Preferably the first roller has a plurality of channels therein, and advantageously has only two channels therein. It is preferred that the first roller has two channels therein, which channels correspond to positions on the second roller that will apply adhesive to the edges of the web material, or to regions towards the edges of the web material.

An alternative adhesive applicator utilises a nozzle operable to spray adhesive under pressure onto the web material. The nozzle is operable to apply a dot, line or coating of adhesive. Such applicator guns are known in the art, and an example is described in WO2004/095957.

Preferably the apparatus comprises a means to feed the web material along a web material feed path. More preferably the means to feed the web material is a metering roller. The metering roller advantageously controls the speed at which web material is fed along the web material feed path. Suitably the metering roller is adjacent a rubber roller and positioned such that the metering roller and rubber roller are capable of feeding web material therebetween.

It is preferred that the apparatus comprises a tracking means. It is more preferred that the tracking means is a paper tracking means to align the web material with the cutting means. Advantageously the tracking means is positioned on the feed path of the web material before the cutting means. Preferably the apparatus comprises a further tracking means to align a wrapper with the assembly for transferring lengths of web material onto a wrapper. Advantageously the tracking means is a paper tracking guide and is positioned on a wrapper feed path before the assembly for transferring lengths of web material onto a wrapper.

Preferably the apparatus comprises a drive roller to feed a wrapper along a wrapper feed path. Advantageously the drive roller is adjacent a pressure roller, the position of the pressure roller and the drive roller allowing the wrapper to be fed therebetween.

Suitably the apparatus comprises a heating means. Preferably the heating means is a heater capable of heating the wrapper having web material thereon and securely bonding the web material to the wrapper. Alternatively the heating means acts as a pre-heater and heats the cigarette wrapper prior to the web material being applied thereto to securely bond the web material to the wrapper.

In an alternative embodiment that does not require the use of two drums to supply web material, the apparatus comprises a slitting means for slitting the web material to form a plurality of strips of web material. Suitably the apparatus comprises a plurality of cutting means and a plurality of assemblies for transferring lengths of web material onto a wrapper. The apparatus also suitably comprises a plurality of adhering means to apply adhesive to the web material. Suitably the plurality of assemblies for transferring lengths of web material onto a wrapper are operable to transfer the lengths of web material to a single wrapper. Preferably the slitting means is operable to slit the web material into two strips of equal width. Advantageously the apparatus comprises two cutting means operable to cut the web material into lengths, two assemblies for transferring lengths of web material onto a wrapper, and two adhering means.

In a second aspect of the invention the adhering means comprises pressure exerting means. Preferably the pressure exerting means comprises a means capable of applying pressure to a wrapper, the wrapper having a length of web material thereon. More preferably the pressure exerting means comprises a pinch roller capable of pressing the wrapper to adhere the web material to the wrapper. Advantageously the pinch roller comprises a belt and a guide means, the belt being positioned about the guide means. More advantageously the pinch roller comprises a plurality of guide means, the guide means being guide rollers. Most preferably the pressure exerting means comprises a plurality of pinch rollers.

All of the features described above are applicable to all aspects of the invention, and in particular should be considered to apply to the product, method of making the product, and to the apparatus.

In order that the subject invention may be easily understood and readily carried into effect, reference will now be made, by way of example, to the accompanying diagrammatic drawings, in which.

Figure 1:
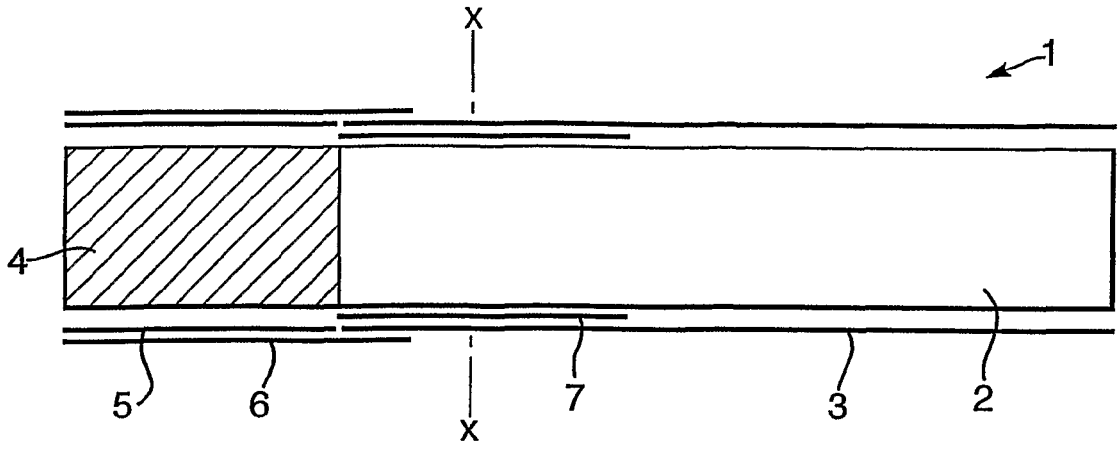
FIG. 1 shows a cross-section longitudinally through a smoking article according to the invention.

FIG. 1 shows a smoking article (1) according to the invention in longitudinal cross-section. The smoking article (1) comprises a rod of smokable material (2) circumscribed by a cigarette wrapper (3). A filter (4) is positioned at the mouth end of the smoking article (1). The filter (4) is circumscribed by a plugwrap (5) and is attached to the rod of smokable material (2) by a tipping paper (6) as is usual in the art. The smoking article (1) has mentholated carbon paper (7) located at an end thereof. The carbon contained in the mentholated carbon paper (7) stabilises and retains the menthol flavourant. The mentholated carbon paper (7) circumscribes the entire circumference of the smoking article (1). The cigarette wrapper (3) surrounds the rod of smokable material (2) and the mentholated carbon paper (7). The end at which the mentholated carbon paper (7) is located corresponds to the mouth end of the smoking article (1).

Upon smoking, the smoking article (1) is lit at one end, such as, for example, an end furthest from the mentholated carbon paper (7) and smoke is drawn along the rod of smokable material (2) to the consumer. Initially, as smoke passes along the smoking article (1) no menthol flavourant is released from the mentholated carbon paper (7) as a result of the smoke temperature being insufficient to cause menthol to be released from the carbon. As the smoking article (1) is further smoked and the burning coal advances along the rod of smokable material (2) towards the mouth end of the smoking article (1) the mentholated carbon paper (7) is rapidly heated by the coal and the temperature is sufficiently high to release the menthol flavourant from the mentholated carbon paper (7). At this point the consumer receives sensorial characteristics including the menthol-flavourant therein.

Figure 2:
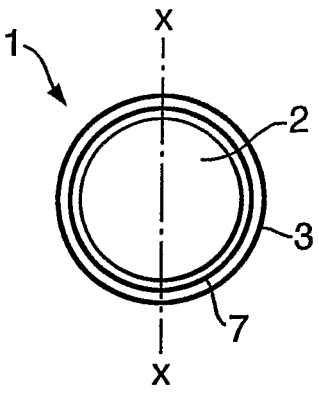
FIG. 2 shows a cross-section through the smoking article of FIG. 1 along line x-x.

FIG. 2 shows a transverse cross-section through the smoking article (1) of FIG. 1 along line x-x showing the wrapper (3) circumscribing the rod of smokable material (2) and the mentholated carbon paper (7) extending around the entire circumference of the rod of smokable material (2) interiorly of the wrapper (3).

Figure 3:
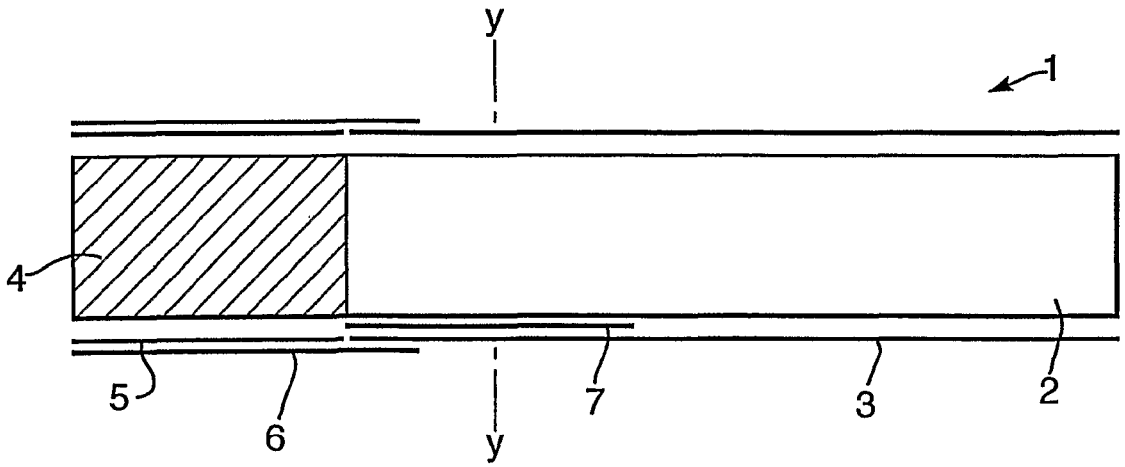
FIG. 3 shows a cross-section longitudinally through a smoking article according to a further embodiment of the invention.

FIG. 3 shows a smoking article (1) in longitudinal cross-section, in which a rod of smokable material (2) is circumscribed by a wrapper (3). A filter (4) circumscribed by a plugwrap (5) is located at the mouth end of the smoking article (1) and is attached to the rod of smokable material (2) by a tipping paper (6). The smoking article (1) has a patch of mentholated carbon paper (7) located at one end thereof. The end at which the mentholated carbon paper (7) is located corresponds to the mouth end of the smoking article (1). The patch of mentholated carbon paper (7) extends over only part of the circumference of the smoking article (1).

Figure 4:
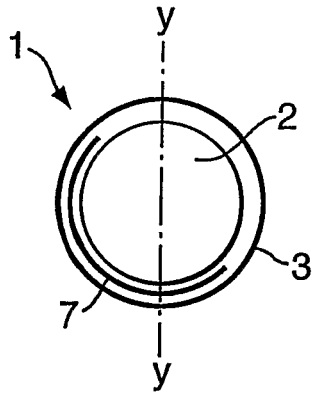
FIG. 4 shows a cross-section through the smoking article of FIG. 3 along line y-y.

FIG. 4 shows a transverse cross-section through the smoking article (1) of FIG. 3 along line y-y, showing the wrapper (3) circumscribing the rod of smokable material (2) and the mentholated carbon paper (7) extending only partially around the circumference of the rod of smokable material (2) interiorly of the wrapper (3).

Figure 5:
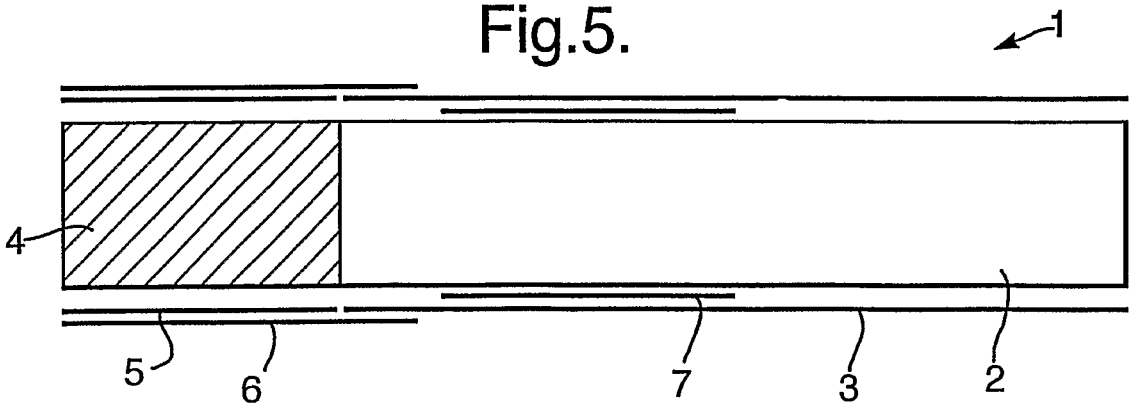
FIG. 5 shows a cross-section longitudinally through a smoking article according to a further embodiment of the invention.

FIG. 5 shows a smoking article (1) in cross-section, in which a rod of smokable material (2) is circumscribed by a wrapper (3). A filter (4) circumscribed by a plugwrap (5) is located at the mouth end of the smoking article (1) and is attached to the rod of smokable material (2) by a tipping paper (6). The smoking article (1) has a patch of mentholated carbon paper (7) located towards one end thereof. The end towards which the mentholated carbon paper (7) is located corresponds to the mouth end of the smoking article (1). The mentholated carbon paper (7) is positioned at a distance from the end of the smoking article (1) corresponding to the mouth end thereof, such that the mentholated carbon paper (7) is near to, but not at, the end of the smoking article (1).

Figure 6:
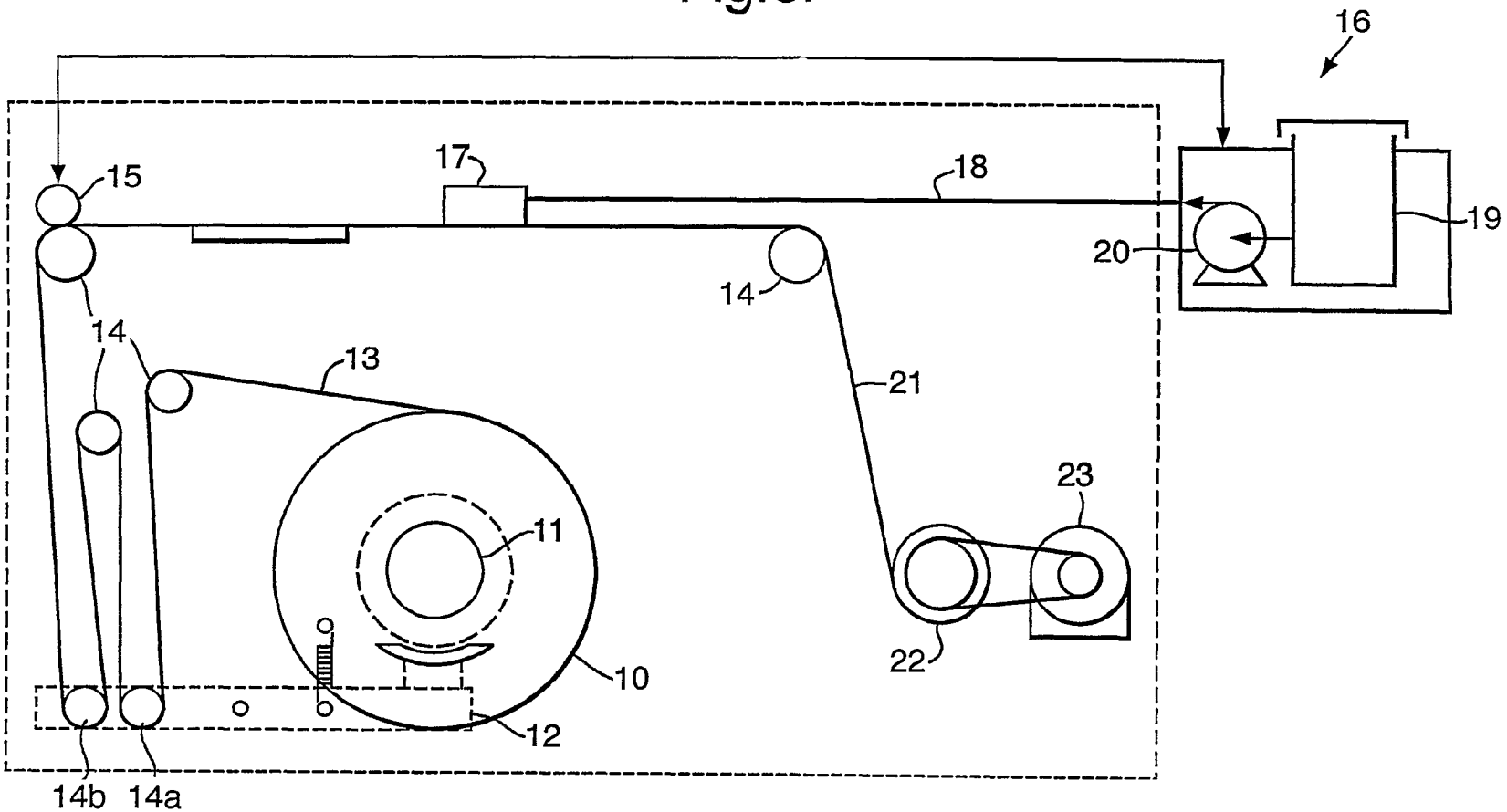
FIG. 6 shows a system for applying a flavourant to a web material according to the invention.

A system for producing flavoured carbon paper is shown in FIG. 6. A bobbin of activated carbon paper (10) is held on a mandrel (11). A brake arm (12) is adjacent to the mandrel (11) and allows the mandrel (11) to rotate and feed carbon paper (13) when under tension. When the carbon paper (13) is not under tension the brake arm (12) acts against the drum of the mandrel (11). The mandrel (11) is known as an "unwind" mandrel. The carbon paper (13) is fed around a number of guide rollers (14) to ensure that the carbon paper (13) is directed along the correct path. The brake arm is connected to two of the guide rollers (14*a*, 14*b*), which guide rollers remain in a lowered position when the carbon paper (13) is slack and serve to keep the brake arm (12) in contact with the drum of the unwind mandrel (11). When contacting the drum the brake arm (12) prevents the unwind mandrel (11) rotating and feeding carbon paper (13) therefrom. This action ensures that the carbon paper (13) is maintained in a pre-tensioned state and serves to prevent the inertia of the bobbin over-feeding the carbon paper (13). When the carbon paper (13) is in a pre-tensioned state the two guide rollers (14*a*, 14*b*) are raised by the tensioned paper and serve to lift the brake arm (12) in contact therewith, resulting in the brake arm (12) being pivoted away from the drum of the unwind mandrel (11) and allowing the carbon paper (13) to be fed from the mandrel. Two guide rollers (14*a*, 14*b*) are utilised in the brake arm assembly to halve the force on the paper at each point, thus reducing the risk of the paper breaking.

An encoder (15) is positioned adjacent to the web material. The encoder (15) is an incremental rotary encoder and contacts the web material such that movement of the carbon paper (13) causes a wheel (not shown) of the encoder (15) to rotate. The number of turns of the wheel of the encoder (15) enables the speed of paper feed from the bobbin to be measured and signals to be sent from the encoder (15) to a flavourant applicator apparatus (16). The signals sent from the encoder (15) to the flavourant applicator apparatus (16) cause the flavourant applicator apparatus (16) to adjust the application of flavourant to the carbon paper (13) according to the speed of feed of the carbon paper (13).

The flavourant applicator apparatus (16) comprising a flavourant applicator head (17), a flavourant supply line (18), a flavourant pump (20) and a flavourant source (19) positioned on the transport path of the carbon paper (13). A suitable flavourant applicator apparatus is, for example, the CFA 1000 Cigarette Flavour Application System of C.B.Kaymich & Co. Ltd. The carbon paper (13) passes beneath the flavourant applicator head (17) which is connected by supply line (18) to the flavourant source (19). Flavourant such as, for example, menthol, is pumped by the flavourant pump (20) from the flavourant source (19) in a molten state along heated supply line (18) to the applicator head (17). The applicator head (17) has 8 orifices in the underside thereof through which the flavourant passes onto a surface of the carbon paper (13). The applicator head has an interchangeable plate therein having orifices thereon, it being possible to replace the plate with another plate having a different number/size/pattern of orifices therein. The flavourant is adsorbed into the activated carbon granules of the carbon paper (13). The flavoured carbon paper (21) is fed over a guide roller (14) onto a mandrel (22), which mandrel (22) rotates to wind the flavoured carbon paper (21) around the mandrel (22). The mandrel (22) is known as a "rewind mandrel". The mandrel (22) is driven by a motor (23). The speed of the motor is controlled to maintain a constant web material speed. When all of the carbon paper (13) from bobbin (10) has had flavourant applied thereto and has been fully rewound onto mandrel (22) the flavoured carbon paper is allowed to equilibrate to ensure that the flavourant is evenly distributed in the web material, as far as is possible. This equilibration process is known as the "bulking" or "curing" stage. The paper is then ready to be incorporated into smoking articles according to the present invention.

Figure 7:
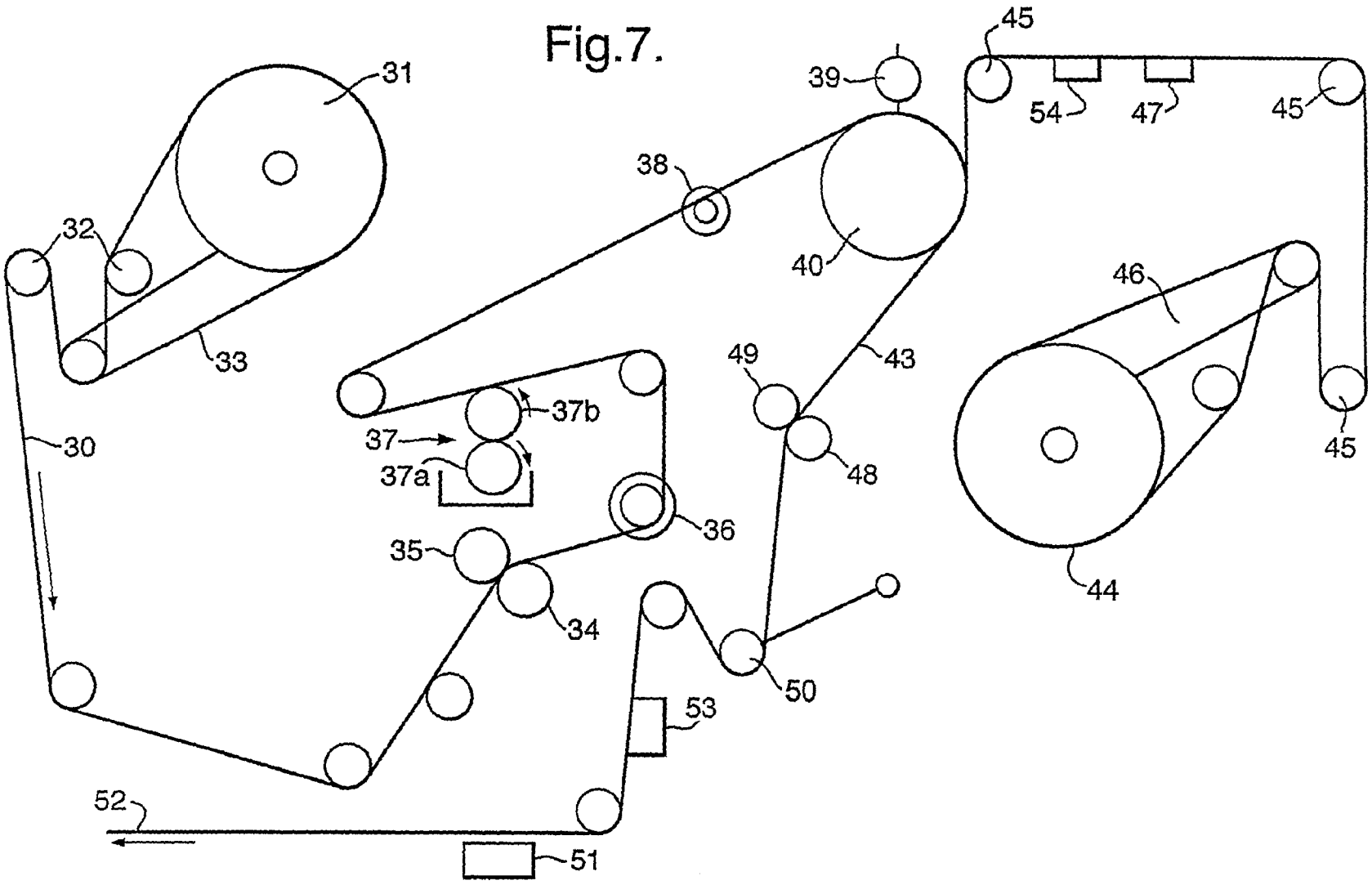
FIG. 7 shows an apparatus for applying web material to a wrapper according to the invention.

FIG. 7 shows a system for applying patches of carbon paper onto a cigarette wrapper. Flavoured carbon paper (30) is supplied from a bobbin (31) over guide rollers (32). A mechanical bobbin brake arm (33), positioned between the bobbin (31) and a guide roller acts to maintain the carbon paper (30) in a pre-tensioned state and serves to prevent the inertia of the rotating bobbin (31) over-feeding the carbon paper (30). The carbon paper (30) passes along a feed path over a series of rollers, including a metering roller (34) that controls the speed at which the carbon paper (30) travels. The metering roller (34) is adjacent to a nip roller (35) which is biased towards the metering roller (34) so that the nip roller (35) effectively pinches the carbon paper (30) and the metering roller (34) feeds the carbon paper (30). A (paper tracking) guide roller (36) is positioned after the metering roller (34) and serves to ensure that the web material is aligned correctly before reaching an adhesive applicator (37).

The adhesive applicator (37) is a gravure gummer comprising two applicator rollers (37*a*, 37*b*). The lower applicator roller (37*a*) is in contact with a well of adhesive and when rotated is coated in adhesive from the adhesive well. The upper applicator roller (37*b*) is in contact with the lower applicator roller (37*a*), and via rotation of the upper and lower applicator rollers adhesive is transferred from the lower applicator roller (37*a*) to the upper applicator roller (37*b*). The upper applicator roller (37*b*) is also in contact with the carbon paper (30) and allows adhesive to be transferred from the surface of the upper applicator roller (37*b*) to a surface of the carbon paper (30). The speed of rotation of the upper and lower applicator rollers of the gravure gummer (37) are timed, in conjunction with the speed of the carbon paper (30) itself, to ensure that adhesive is accurately applied to the carbon paper (30). The adhesive may be applied intermittently to the carbon paper (30) or may be applied continuously. Varying patterns of adhesive application to the carbon paper (30) are achieved by altering the surface of the lower applicator roller (37*a*). Adhesive may be applied, for example, across the entire surface of the carbon paper (30) or in two lines each of 2 mm width at the edges of the carbon paper (30) or spaced approximately 2 mm from the edges of the carbon paper (30).

A second (paper tracking) guide roller (38) is positioned before a rotary knife assembly (39) and ensures that the web material is correctly aligned with the suction stations on the drum assembly (40) prior to being cut into sections.

Figure 8:
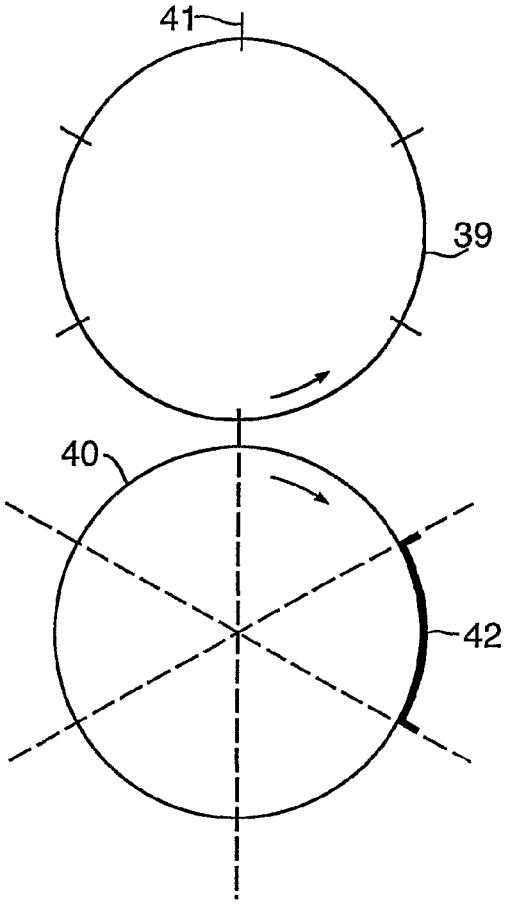
FIG. 8 shows a cross-section through a part of the apparatus of FIG. 7.

The rotary knife assembly (39) is located adjacent to a drum assembly (40) comprising a vacuum drum. The vacuum drum is rotatable and has a suction force applied to the interior thereof and has a number of holes in the surface thereof to allow the suction force to be conveyed to objects on the surface of the vacuum drum. The rotary knife assembly (39) comprises six knives that rotate and cut across the width of the carbon paper (30) against the single drum assembly (40). The rotary knife assembly (39) is driven by gears from the drum assembly (40) such that the knives correspond to one of six positions on the drum assembly (40). Each of the six positions on the drum assembly (40) corresponds to a patch station on the surface of the vacuum drum. FIG. 8 shows a circumferential pitch (42) of the drum assembly (40) and the direction of travel of the drum assembly (40) and the rotary knife assembly (39), having knives (41) thereon. The sections of carbon paper (30) produced by the cuts coincide with the six positions on the drum assembly (40). The surface speed of each knife substantially corresponds to the surface speed of the vacuum drum of the drum assembly (40). The length of the patches of web material is controlled by the speed of the web material and the surface speed of the vacuum drum, together with the pitch of patch stations on the vacuum drum. The following formula is used to calculate patch length:

$$\text{Patch length} = P \times V_1 / V_2, \text{ wherein:}$$

P=pitch of stations on vacuum drum (mm)

$V_1$=speed of web material (m/min)

$V_2$=surface speed of vacuum drum (m/min)

For example, at a speed of 3,000 cigarettes per minute, a station pitch of 114 mm, a web material speed of 90 m/min, and for a tobacco rod length of 57 mm, $$V_2 \text{ is } 3000 \times 57/1000 = 171 \text{ m/min}$$

Therefore, Patch length is 114×90/171=60 mm

After being cut into patches the carbon paper (30) is held on the rotatable vacuum drum of the drum assembly (40). The vacuum drum having the sections of carbon paper (30) held on the outer surface thereof rotates to allow transfer of the carbon paper (30) to a cigarette paper (43). The vacuum drum rotates at a speed synchronised with the speed of a knife on the cigarette making machine. One revolution of the knife on the cigarette making machine results in a wrapper equating to a single cigarette, whilst one revolution of the vacuum drum results in a length of wrapper equivalent to twelve cigarettes. Accordingly, the speed of rotation of the vacuum drum is one-twelfth that of the speed of the knife on the cigarette making machine, and approximately equates to the speed of feed of the cigarette paper.

Cigarette paper (43) is held on a cigarette paper bobbin (44), from which bobbin (44) the cigarette paper (43) is supplied over guide rollers (45). A bobbin brake arm (46) acts to maintain the tension of the cigarette paper (43), in the same manner as previously described for the carbon paper. The cigarette paper (43) is fed along a paper feed path comprising a number of guide rollers (45) which serve to control the direction of feed of the cigarette paper (43). A paper tracking guide means (47) is located along the paper feed path between guide rollers (45) and allows precise tracking control of the supply of the cigarette paper (43). The paper tracking guide means (47) may be adjusted to change the path of the cigarette paper (43), allowing the cigarette paper (43) to be aligned with the sections of carbon paper transferred from the rotatable drum of the drum assembly (40). Optionally, a pre-heater (54) is positioned to pre-heat the cigarette paper (43) prior to the cigarette paper (143) contacting the vacuum drum (40).

As the cigarette paper (43) passes over the drum assembly (40) sections of carbon paper held on the surface of the rotatable drum are transferred to the surface of the cigarette paper (43) contacting the carbon paper sections. The sections of carbon paper are transferred to and held by the cigarette paper (43) as a result of the adhesive on the surface of the carbon paper sections. The cigarette paper (43) contacts the drum assembly (40) at an angle to allow the cigarette paper (43) to be in contact with the drum assembly (40) for a longer time. Contact between the cigarette paper (43) and the drum assembly (40) is affected by their respective positions and the tension of the cigarette paper (43) which allows some degree of slippage of the cigarette paper (43) relative to the drum assembly (40). This slippage allows the patch position to be corrected relative to the cut of the smoking article on a cigarette making machine. Subsequent to the transfer of the carbon paper sections to the cigarette paper (43) the cigarette paper (43) passes between a feed roller (48) and a pinch roller (49). The feed roller (48) feeds the cigarette paper (43) in response to demand from the cigarette making machine and is driven independently from the drum assembly and the patch feed system. The pressure exerted on the cigarette paper (43) by the feed roller (48) and the pinch roller (49) aids in the adherence of the patches to the cigarette paper (43). A buffer element (50) allows speed changes between the feed roller (48) and the cigarette making machine to occur. The speed of the feed roller (48) is regulated to control patch pitch on the cigarette paper and prevent "drift" of the patch over time, this being the rate of change of the relative position of the patch over time.

A sensor (51) is mounted immediately prior to the garniture (52) of the cigarette making machine and serves to detect the position of the patch on the cigarette paper (43) in relation to the cutting knife of the cigarette making machine. The speed of the drum assembly (40) may be momentarily altered relative to the speed of the cigarette paper (43) to ensure that the patch is in the correct position on the cigarette paper (43), in relation to the cigarette making machine and accordingly will be correctly positioned in the finished smoking article. This control system automatically and momentarily accelerates the drum (40) to effect a position change of the patch on the cigarette paper. A further sensor is optionally positioned immediately after the feed roller (48) to measure the position of the patch and feed back into the machine control system.

Optionally, a heater (53) is positioned on the feed path of the cigarette paper (43) and heats the cigarette paper (43) particularly but not exclusively in the region of the carbon paper (30) to securely bond the carbon paper to the cigarette paper (43). If heat-activatable adhesive is used the heat from the heater (53) activates the adhesive to ensure an effective bond.

The cigarette paper having carbon paper attached thereto proceeds to a conventional rod forming garniture, which rod forming garniture may be, for example, a cigarette making machine.

Figure 9:
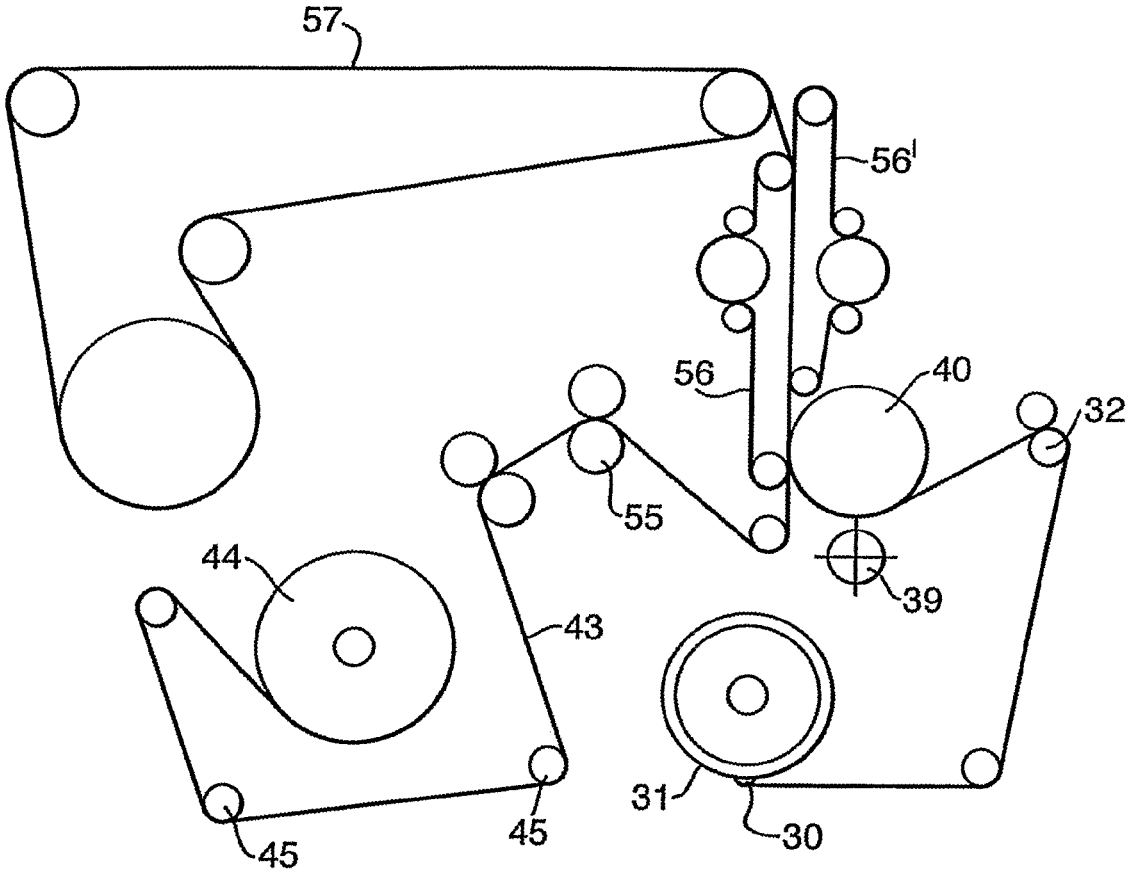
FIG. 9 shows an apparatus for applying web material to a wrapper according to a further embodiment of the invention.

FIG. 9 shows a further system for feeding carbon paper onto a wrapper. Flavoured carbon paper (30) is fed from a bobbin (31) along a feed path. The carbon paper (30) is fed past a metering roller (32) that serves to control the speed of supply of the carbon paper (30) in the same manner as previously described in relation to FIG. 7. A rotary knife assembly (39) having a knife thereon cuts the carbon paper (30) into lengths. The lengths of carbon paper are held on the surface of the vacuum drum assembly (40) by suction forces within the drum. The vacuum drum rotates to transfer the lengths of carbon paper from the vacuum drum assembly (40) to a cigarette paper (43) and deposit the carbon paper lengths onto a surface of the cigarette paper (43).

Cigarette paper or wrapper (43) is held on a bobbin (44) and is supplied therefrom along a paper feed path. The cigarette paper (43) is fed over a number of guide rollers (45) before passing a drag roller (55) that serves to maintain the tension of the cigarette paper (43). The cigarette paper (43) passes the drum assembly (40) and contacts the carbon paper lengths held on the surface thereof. A release of the suction from the vacuum drum causes the leading edge of the length of carbon paper to leave the vacuum drum. The cigarette paper (43) and the leading edge of the length of carbon paper enter between a pair of pinch belts (56, 56'), one on each side of the cigarette paper feed path. The pinch belts (56, 56') squeeze the cigarette paper (43) and carbon paper lengths therebetween and serve to press the lengths of carbon paper onto the cigarette paper (43). As the cigarette paper (43) and the length of carbon paper advance through the pinch belts (56, 56') the trailing edge of the length of carbon paper is released from the suction drum and is also pressed onto the cigarette paper (43). Each pinch belt (56, 56') comprises a belt running around two guide rollers, each located at an opposite end of the pinch belt (56, 56'). Further rollers operate to drive the pinch belts (56, 56') and to maintain tension therein.

The cigarette paper having carbon paper thereon is then fed to a rod forming garniture (57). The rod forming garniture (57) is, for example, a cigarette making machine.

Figure 10:
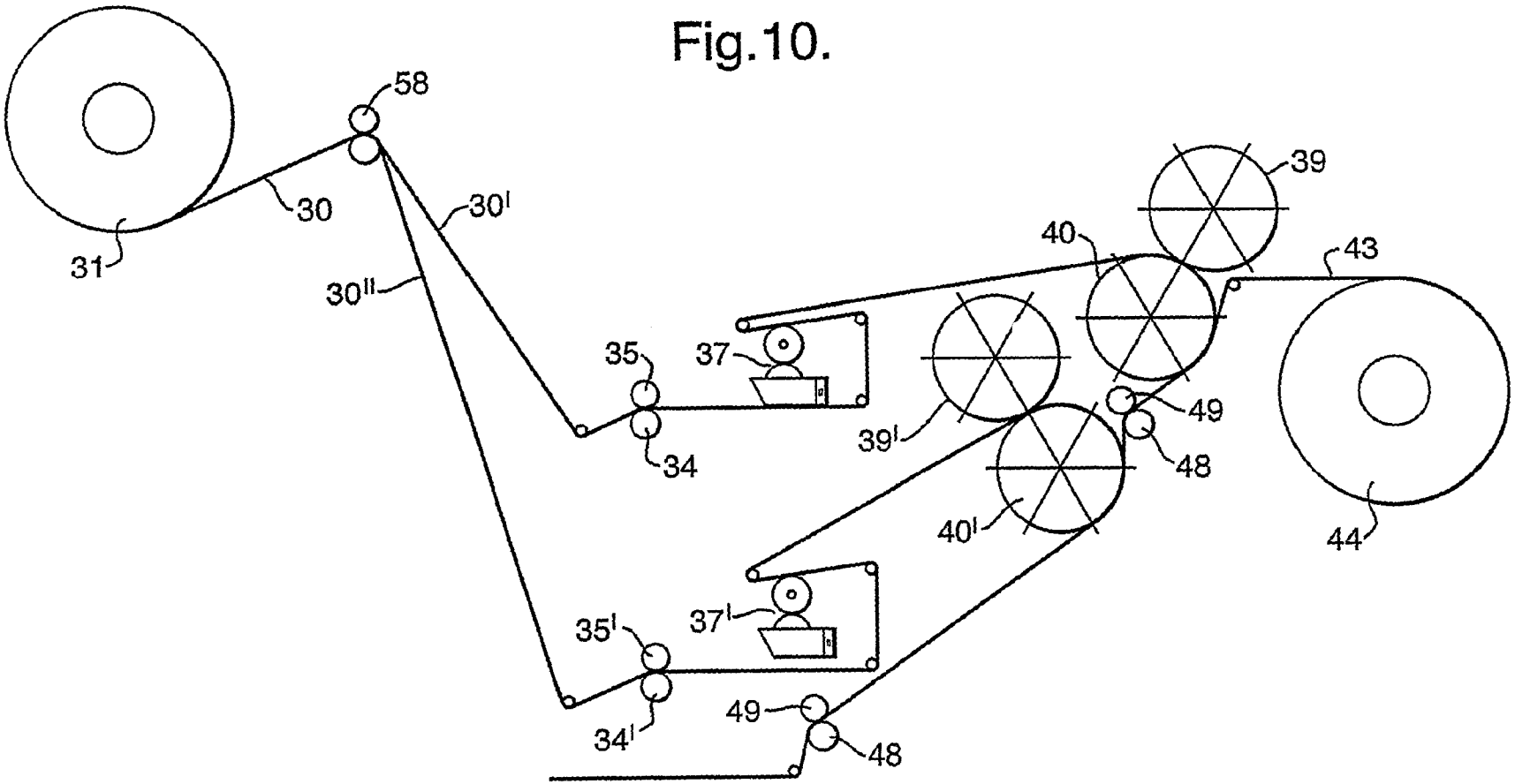
FIG. 10 shows an apparatus for applying web material to a wrapper according to a further embodiment of the invention.

FIG. 10 shows a further system according to the invention in which a flavoured carbon paper (30) having a width of for example 48 mm is supplied from a bobbin (31) and is fed along a web material feed path to a slitting unit (58) which slits the flavoured carbon paper (30) into two strips (30', 30") of carbon paper having the desired width, for example each of the two strips being 24 mm wide strips. Each of the strips of flavoured carbon paper (30', 30") is fed to a feed roller (34, 34') and a pinch roller (35, 35'). Each strip of flavoured carbon paper (30', 30") is then fed to an adhesive applicator (37, 37') operable to apply adhesive to a surface of the flavoured carbon paper (30', 30") prior to each of the strips of flavoured carbon paper (30', 30") being supplied to a vacuum drum (40, 40') and a knife assembly (39, 39'). Each knife assembly (39, 39') is operable to cut the strips of flavoured carbon paper (30', 30") into sections, which sections are transferred from the respective vacuum drum (40, 40'), on the surface of which drum the sections are held, onto a cigarette wrapper (43). The sections of carbon paper are transferred such that the surface having adhesive thereon is contacted by the cigarette paper, ensuring that each section is securely held on the cigarette paper. The cigarette wrapper (43) is supplied from a cigarette paper bobbin (44) along a cigarette wrapper feed path to each vacuum drum (40, 40') to allow each vacuum drum (40, 40') to transfer the lengths of flavoured carbon paper (30, 30', 30") therefrom onto the cigarette paper (43). As shown the cigarette paper (43) is fed to vacuum drum (40) at which sections of carbon paper are transferred from the drum onto the cigarette paper (43). The cigarette paper (43) is then fed to a feed roller (48) and a pinch roller (49), which rollers are at an angle relative to the vacuum drum (40) such that the cigarette paper (43) is contacted by the drum (40) over a greater surface, allowing more contact time between patches and the cigarette paper prior to leaving the drum (40). The cigarette paper (43) then feeds to the next vacuum drum (40') at which further sections of carbon paper are transferred onto the cigarette paper (43). After having the sections of carbon paper applied thereto the cigarette wrapper (43) is fed between a further drive roller (48) and a pinch roller (49) and onto a cigarette making machine (not shown).

The use of a system having two web material feed paths allows the embodiment shown in FIG. 5 to be produced by allowing the patches to be spaced from the filter of the cigarette. This system also allows a greater number of patches to be applied to a cigarette wrapper than a single web material feed path. Further, a double drum system or a splitting of a web material from a bobbin allows a wider bobbin to be used and requires the bobbin to be changed less frequently. Each of the two vacuum drums transfers sections of web material to positions on the cigarette wrapper between positions on the cigarette wrapper at which the other drum transfers sections of web material. For example, the second vacuum drum (40') transfers sections of web material to the cigarette wrapper (43) such that each section of web material is transferred to the cigarette wrapper (43) at a position between two sections of web material on the cigarette wrapper (43) transferred by the first vacuum drum (40).

EXAMPLE 1

Sample cigarettes were made having a 30×24 mm mentholated carbon paper patch, positioned near the filter end of the cigarettes, containing 5 mg menthol per patch. These samples were stored at 22° C. and 60% relative humidity (RH) in sealed packs for 16 weeks. The cigarettes had a 56 mm tobacco rod, a 27 mm filter, and had a diameter of 24.6 mm with the mentholated carbon patch attached to the paper wrapper and encircling the final 30 mm of the tobacco rod next to the filter. The blend used in the tobacco rod was a USB style with cased burley, Virginia and reconstituted tobaccos. The filters were cellulose acetate with a pressure drop of 108 and the cigarette paper specification was 26.92 gsm, 75CU permeability, 1% mixed citrate as a burn additive, and made of mixed fibres. The cigarettes were evaluated by a sensory panel in a duo-trio test. The duo-trio test is the most commonly used difference test in the sensory evaluation of cigarettes and is extremely useful for detecting small potential differences resulting from small product or process changes. In such a test assessors are presented with three samples, one of which is identified as the control. Of the other two samples, one is identical to the control; the other is not the same as the control(s). Assessors are asked to identify which of the remaining two samples is the same as the control sample. The Binomial Distribution is used to determine statistically whether an identified difference is a chance observation. Typically, data from a minimum of 20 assessments are required for the duo-trio test, which can be obtained by repeat tests from 10 assessors. Using the duo-trio regime no menthol was detected in the portion of the cigarette tobacco rod without the carbon patch.

The cigarettes were also analysed for menthol migration within the cigarette after storage for 16 weeks, the results of which are shown in Table 1 below.

TABLE 1

| Menthol Content (mg/cig) | | | | | |
|---|---|---|---|---|---|
| 27 mm of tobacco rod at lighting end | 30 mm of tobacco rod at mouth end | Filter | Cigarette Paper | Carbon Paper | Total |
| 0.000 | 0.005 | 0.018 | 0.009 | 4.55 | 4.58 |

EXAMPLE 2

Sample cigarettes were made in accordance with the following format specification: 56 mm tobacco rod, 27 mm filter and 24.6 mm cigarette diameter with the mentholated carbon paper patch attached to the paper wrapper and encircling the last 30 mm of the tobacco rod next to the filter. The blend used was a full USB containing cased burley, oriental, Virginia and reconstituted tobaccos. The filters were cellulose acetate with a pressure drop of 108 and the cigarette paper specification was 26.92 gsm, 50 CU permeability, 2% mixed citrate as a burn additive, and made of mixed fibres. The cigarettes included a 30×24 mm carbon patch (40% PNC100) containing 5 mg menthol. The samples were subsequently stored at 22° C. and 60% RH in sealed packs for a time period of 5 months prior to analysis.

Figure 11:
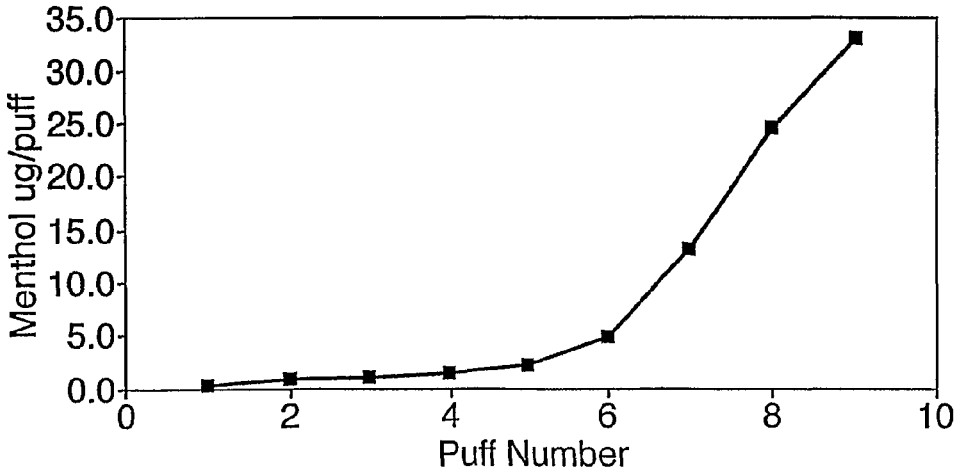
FIG. 11 shows menthol delivery on a puff by puff basis for a sample product.

Menthol delivery on a puff by puff basis is depicted in FIG. 11 and highlights the absence of menthol delivery in the first puffs and a significant delivery of menthol in the final few puffs. The cigarette samples were also analysed to determine menthol migration within the cigarette after storage for 5 months, the results of which are shown in Table 2 below.

TABLE 2

| Menthol Content (mg/cig) | | | | | |
|---|---|---|---|---|---|
| 27 mm of tobacco rod at lighting end | 30 mm of tobacco rod at mouth end | Filter | Cigarette Paper | Carbon Paper | Total |
| 0.008 | 0.018 | 0.037 | 0.007 | 4.44 | 4.51 |

EXAMPLE 3

Cigarette samples were constructed having activated charcoal filters and activated carbon paper patches 30×24 mm in length positioned at the filter end of the tobacco rod of the cigarettes. Patches contained menthol at a level equivalent to 6 mg per cigarette. A control cigarette was also constructed in which the activated charcoal filter was replaced with a standard cellulose acetate filter. Both products Were matched in design, and delivered approximately 6 mg total particulate matter (TPM).

Analyses were performed 3 months after manufacture for a range of smoke components, including vapour phase, carbonyls and hydrogen cyanide (HCN). The results are given as a percent reduction, based upon μg/mg TPM, for the sample compared to the control and are shown in Table 3.

TABLE 3

| Component | Sample (% reduction) |
|---|---|
| Vapour Phase | 47 |
| Carbonyls | 36 |
| HCN | 45 |
| Average reduction | 43 |

As can be seen from Table 3 significant reductions in all components are achieved demonstrating that the effect of an activated charcoal filter is not compromised by the inclusion of a mentholated carbon paper patch positioned at the filter end of the cigarette.

EXAMPLE 4

Cigarette samples were made having three different menthol levels within products having differing blend and tar yields. All samples had an activated charcoal filter and a mentholated carbon paper patch of either 30×23 mm or 34×23 mm length positioned near the filter end of the cigarette. Analyses were performed two months after manufacture for a range of smoke components, including vapour phase, carbonyls and HCN. The results are given as a percent reduction, based upon μg/mg TPM for each sample compared to a non-mentholated control that did not comprise a carbon paper patch and are shown in Table 4 below.

TABLE 4

| Blend | TPM (mg/cig) | Patch length (mm) | Menthol (mg/cig) | % Reductions Vapour Phase | Carbonyls | HCN | Average reduction |
|---|---|---|---|---|---|---|---|
| A | 6 | 30 × 23 | 6 | 14 | −8 | −24 | −6 |
| B | 9 | 30 × 23 | 4.8 | 10 | −4 | −2 | 2 |
| B | 9 | 34 × 23 | 6.5 | 18 | 18 | 13 | 16 |
| B | 6 | 30 × 23 | 4.8 | 20 | 13 | 11 | 14 |
| B | 6 | 34 × 23 | 6.5 | 10 | 19 | 15 | 15 |

Negative values indicate an increase in the components for the mentholated product compared to the control product (not specified). As can be seen, the changes in all levels of the components measured are close to zero for the mentholated carbon paper product compared to the non-mentholated control. Vapour phase results tend to show a slight reduction for mentholated products, however it is generally accepted by those skilled in the art that results within +/−15% are not significantly different. No significant change is caused by menthol to the ability of activated charcoal filters to reduce selected volatile smoke components when mentholated carbon paper is incorporated into a cigarette and positioned near to the mouth end.

Table 5 provides a list of the different types of aroma compounds that have been evaluated and found to be compatible with activated carbon powder (PNC60). Physical data and thermal release characteristics of the aroma compounds are also shown. Thermal release data are obtained using a Programmable Temperature Vaporisation—Mass Spectrometry (PTV-MS) analytical technique, known to those in the art, with a temperature ramp ranging from 20° C. to 350° C.

TABLE 5

| Compound Name | Type | Sub-type | Boiling Point/° C. | Molecular weight/amu | Typical Start point of Thermal Release/° C. |
|---|---|---|---|---|---|
| Menthol | Alcohol | Cyclic Terpene alcohol | 212 | 156 | 152 |
| Methyl Benzyl Acetate | Ester | Aromatic ester | 206-214 | 150.20 | 136 |
| Butyl Butyrate | Ester | Aliphatic ester | 165 | 144.21 | 137 |
| Propyl Acetate | Ester | Aliphatic ester | 102 | 102.13 | 107 |
| Phenyl Ethyl Isovalerate | Ester | Aromatic ester | 264 | 206.28 | 216 |
| Butyl Valerate | Ester | Aliphatic ester | 186.5 | 158.24 | 206 |
| Methyl Cinnamate | Ester | Aromatic ester | 126-127 | 116.16 | 221 |
| Ethyl Cinnamate | Ester | Aromatic ester | 271-272 | 176.22 | 233 |
| Diacetyl | Ketone | Di-ketone | 87-88 | 86.09 | 128 |
| Cis-3-Hexen-1-ol | Alcohol | Unsaturated alcohol | 57 | 98.14 | 137 |
| Iso Amyl Acetate | Ester | Aliphatic ester | 145 | 130.18 | 157 |
| Ethyl Acetoacetate | Ester | Aliphatic ester | 181 | 130.14 | 112 |
| Citral | Aldehyde | Acyclic terpene aldehyde | 103-107 | 152.23 | 148 |
| Manderin Oil | Complex mixture | — | — | — | 184 |
| Tangerine Oil | Complex Mixture | — | — | — | 160 |
| Decanal | Aldehyde | Aliphatic aldehyde | 209 | 156.26 | 198 |
| Nonanal | Aldehyde | Aliphatic aldehyde | 93 | 142.24 | 200 |
| α-Phellandrene | Terpene hydrocarbon | Monoterpene hydrocarbon | 175 | 136.23 | 164 |
| 3-Ethyl-2-Hydroxy-2-cyclopenten-1-one | Terpene hydrocarbon | Cyclic terpene hydrocarbon | 78-80 | 126.13 | 136 |
| Phenyl Ethyl Alcohol | Alcohol | Aromatic alcohol | 219 | 122.17 | 176 |
| Cyclamen Aldehyde | Aldehyde | Aromatic aldehyde | 270 | 190.28 | 190 |
| Rhodinol | Alcohol | Unsaturated alcohol | 222 | 156.26 | 176 |

TABLE 5-continued

| Compound Name | Type | Sub-type | Boiling Point/ ° C. | Molecular weight/ amu | Typical Start point of Thermal Release/° C. |
|---|---|---|---|---|---|
| Rose Oxide | Heterocycle | Unsaturated O-heterocycle (cyclic ether) | 230 | 154.24 | 170 |
| Eucalyptol | Heterocycle | Aliphatic O-heterocycle (cyclic ether) | 176 | 154.24 | 145 |
| Cinnamyl Alcohol | Alcohol | Aromatic alcohol | 258 | 134.17 | 198 |
| Cuminaldehyde | Aldehyde | Aromatic aldehyde | 248-250 | 132.15 | 185 |
| Benzaldehyde | Aldehyde | Aromatic aldehyde | 178 | 106.12 | 120 |
| 4-Ethylbenzaldehyde | Aldehyde | Aromatic aldehyde | 221 | 134.17 | 174 |
| D-Carvone | Ketone | Cyclic terpene ketone | 230 | 150.21 | 214 |
| L-Carvone | Ketone | Cyclic terpene ketone | 231 | 150.21 | 210 |
| Iso-menthone | Ketone | Cyclic terpene ketone | 210 | 154.24 | 228 |
| Menthone | Ketone | Cyclic terpene ketone | 207 | 154.24 | 226 |

Figure 12:
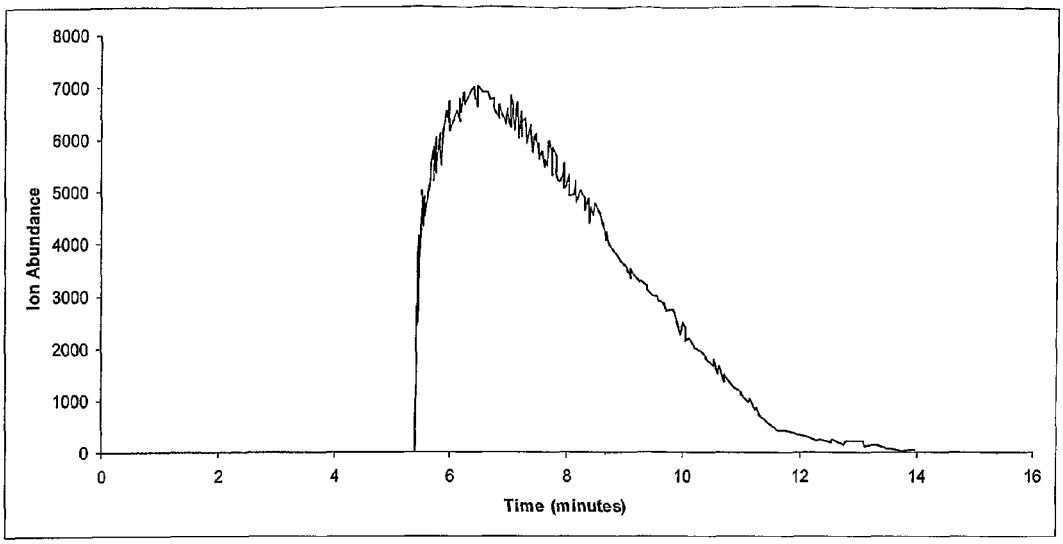
FIG. 12 shows the thermal release profile for menthol adsorbed on activated carbon.

A typical thermal release profile, from PTV-MS analysis, for menthol adsorbed on PNC60 activated carbon powder is provided in FIG. 12. Abundance of the menthol ion is plotted against time. The temperature at time zero is 20° C., and increases at a rate of 30° C. per minute. The thermal release of menthol corresponds to a temperature of around 150° C.

Table 6 provides a list of selected flavours that were applied to activated carbon paper and tested for thermal release. Thermal release data are obtained using a Programmable Temperature Vaporisation—Mass Spectrometry (PTV-MS) analytical technique, known to those in the art, with a temperature ramp ranging from 20° C. to 350° C.

TABLE 6

| Flavour Compounds on Carbon Paper | Mean Thermal release/° C. |
|---|---|
| Menthol | 117 |
| Benzaldehyde | 70 |
| Rose oxide | 98 |
| Nonanal | 173 |

The invention claimed is:

1. A smoking article for delivering flavourant to a smoker only during the smoking of a selective portion of the smoking article comprising a rod of smokable material, a wrapper about said rod of smokable material and a web material comprising an adsorbent material and a flavourant, the web material being positioned between said rod of smokable material and said wrapper, wherein said web material extends over only a selective portion of the length of the rod of smokable material in order to deliver flavourant to a smoker only during the smoking of said selective portion.

2. A smoking article according to claim 1, further comprising a filter element containing an adsorbent material operable to reduce vapour phase components of smoke during smoking.

3. A smoking article according to claim 1, wherein the web material is a cellulosic sheet material.

4. A smoking article according to claim 3, wherein the cellulosic sheet material is paper.

5. A smoking article according to claim 1, wherein said adsorbent material is incorporated within the web material as an integral component.

6. A smoking article according to claim 1, wherein said adsorbent material is activated carbon.

7. A smoking article according to claim 1, wherein said adsorbent is in granular, powder or particulate form having a mean particle size less than 20 μm.

8. A smoking article according to claim 1, wherein the loading level of adsorbent in said web material is 10-45% by weight of the web material.

9. A smoking article according to claim 1, wherein said flavourant is one or more of the following: menthol, alcohols, esters, ketones, lactones, essential oils, and aldehydes.

10. A smoking article according to claim 1, wherein said web material is adhered to an inner surface of said wrapper.

11. A smoking article according to claim 1, wherein said portion is at or towards the mouth end of said rod of smokable material.

12. A smoking article according to claim 1, wherein said portion is at or towards the lighting end of said rod of smokeable material.

13. A smoking article according to claim 1, wherein the smoking article comprises two or more separate web materials, each web material containing an adsorbent and a flavourant.

14. A smoking article according to claim 1, wherein the web material comprises two different flavourants, including multiple lines of separate individual flavourants or mixtures of flavourants.

15. A smoking article according to claim 1, wherein the rod of smokable material comprises tobacco material having a flavourant applied thereto.

16. A method of making a smoking article for delivering flavourant to a smoker only during the smoking of a selective portion of the smoking article comprising a rod of smokeable material, said method comprising feeding a web material, the web material comprising an adsorbent material and a flavourant, to a cutting means, cutting said web material into sections, having a length which extends only over a selective portion of the length of said rod of smokeable material in order to deliver flavourant to a smoker only during the smoking of said selective portion, transferring one of said sections onto a wrapper and circumscribing said rod of smokable material with said wrapper.

17. A method according to claim 16, wherein said web material is cut into two sections having a combined length corresponding to twice the length of said web material in said smoking article.

18. A method according to claim 16, wherein said web material is transferred onto said wrapper at or towards a position corresponding to the mouth end of the smoking article.

19. A method according to claim 16, wherein adhesive is applied to a surface of said web material before said web material is cut into sections.

20. A method according to claim 19, wherein said surface having adhesive applied thereto is transferred onto the wrapper such that the adhesive contacts said wrapper.

21. A method according to claim 19, wherein said adhesive is applied in a strip along or towards an edge of said web material.

22. A method according to claim 16, wherein adhesive is applied to a surface of said wrapper before said web material is transferred onto the surface of said wrapper.

23. A method according to claim 19, wherein said wrapper is heated to bond the section of web material to said wrapper.

24. A method according to claim 16, wherein a pressure is applied to said wrapper after said sections have been transferred onto said wrapper to adhere said web material to said wrapper.

25. A method according to claim 16, wherein said wrapper is fed along a wrapper feed path and contacts said sections of web material.

26. A method according to claim 25, wherein said wrapper is guided along the wrapper feed path to align said wrapper with said sections of web material.

27. A method according to claim 16, wherein said sections of web material are transferred by a vacuum drum assembly.

28. A method according to claim 16, wherein said sections of web material are transferred onto said wrapper at a speed substantially equal to the speed of said wrapper.

29. A method according to claim 16, wherein said web material is slit to form at least two web material feed paths.

30. A method according to claim 29, wherein said sections are transferred from said at least two web material feed paths onto a single wrapper.

31. An apparatus for making a smoking article for delivering flavourant to a smoker only during the smoking of a selective portion of the smoking article comprising a rod of smokeable material, said apparatus comprising a means for supplying a web material containing an adsorbent and a flavourant to a cutting means, a cutting means operable to cut the web material into sections with a length that extends only over a selective portion of the length of said rod of smokeable material in order to deliver flavourant to a smoker only during the smoking of said selective portion, an assembly for transferring sections of web material onto a wrapper, an adhering means to bond the web material onto a wrapper, and smoking article forming means.

32. An apparatus according to claim 31, wherein the cutting means comprises a housing having a knife mounted thereon.

33. An apparatus according to claim 31, wherein said housing is rotatable.

34. An apparatus according to claim 31, wherein said cutting means is in contact with said assembly for transferring sections of web material.

35. An apparatus according to claim 31, wherein said assembly for transferring sections of web material is a suction drum.

36. An apparatus according to claim 31, wherein said adhering means comprises an adhesive applicator.

37. An apparatus according to claim 31, wherein a web material feeding means is operable to control the speed at which said web material is fed.

38. An apparatus according to claim 37, wherein said web material feeding means is a metering roller.

39. An apparatus according to claim 31, wherein a tracking means aligns said web material with said cutting means.

40. An apparatus according to claim 31, wherein a heating means operable to heat said wrapper is provided.

41. An apparatus according to claim 31, wherein a slitting means is provided to slit said web material to form at least two feed paths of web material.

42. An apparatus according to claim 41, wherein at least two of each of the following is provided: cutting means, assembly for transferring sections of web material onto a wrapper and adhering means.

43. An apparatus according to claim 31, wherein said adhering means comprises a pressure exerting means operable to apply pressure to said wrapper.

44. An apparatus according to claim 43, wherein said pressure exerting means comprises a pinch roller.

* * * * *